US009605217B2

(12) United States Patent
Sundararaman et al.

(10) Patent No.: US 9,605,217 B2
(45) Date of Patent: Mar. 28, 2017

(54) SEQUENTIAL SLURRY HYDROCONVERSION OF HEAVY OILS

(71) Applicants: Ramanathan Sundararaman, Frederick, MD (US); Thomas Francis Degnan, Jr., Philadelphia, PA (US); Rustom Merwan Billimoria, Hellertown, PA (US); Randolph J. Smiley, Hellertown, PA (US)

(72) Inventors: Ramanathan Sundararaman, Frederick, MD (US); Thomas Francis Degnan, Jr., Philadelphia, PA (US); Rustom Merwan Billimoria, Hellertown, PA (US); Randolph J. Smiley, Hellertown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 276 days.

(21) Appl. No.: 14/308,912

(22) Filed: Jun. 19, 2014

(65) Prior Publication Data

US 2015/0021233 A1 Jan. 22, 2015

Related U.S. Application Data

(60) Provisional application No. 61/837,377, filed on Jun. 20, 2013.

(51) Int. Cl.

| | |
|---|---|
| ***C10G 65/02*** | (2006.01) |
| ***C10G 45/16*** | (2006.01) |
| ***C10G 47/26*** | (2006.01) |
| ***C10G 49/12*** | (2006.01) |
| ***C10G 65/10*** | (2006.01) |
| ***C10G 65/12*** | (2006.01) |

(52) U.S. Cl.
CPC ..... *C10G 65/02* (2013.01); *C10G 45/16* (2013.01); *C10G 47/26* (2013.01); *C10G 49/12* (2013.01); *C10G 65/10* (2013.01); *C10G 65/12* (2013.01)

(58) Field of Classification Search
CPC ..... C10G 65/02
See application file for complete search history.

(56) References Cited

U.S. PATENT DOCUMENTS

| | | | | |
|---|---|---|---|---|
| 4,762,607 | A | 8/1988 | Aldridge et al. | |
| 5,755,955 | A | 5/1998 | Benham et al. | |
| 6,190,542 | B1 * | 2/2001 | Comolli | B01J 23/745 208/413 |
| 2010/0122939 | A1 | 5/2010 | Bauer et al. | |
| 2011/0210045 | A1 * | 9/2011 | Kou | C10G 47/02 208/59 |
| 2013/0075303 | A1 | 3/2013 | Heraud et al. | |
| 2013/0112593 | A1 | 5/2013 | Montanari et al. | |
| 2013/0126392 | A1 * | 5/2013 | Koseoglu | C10G 47/26 208/108 |

OTHER PUBLICATIONS

PCT Application No. PCT/US2014/043101, Communication from the International Searching Authority, Form PCT/ISA/210, dated Sep. 24, 2014, 9 pages.

* cited by examiner

*Primary Examiner* — Randy Boyer
(74) *Attorney, Agent, or Firm* — Jamie L. Sullivan

(57) ABSTRACT

Systems and methods are provided for sequential slurry hydroconversion of heavy oil feedstocks. One or more low pressure slurry hydroconversion stages can be used to perform a majority of the conversion of a heavy oil feedstock. The bottoms from the low pressure stages can then be slurry hydroconverted in one or more high pressure stages to further convert the feedstock.

19 Claims, 6 Drawing Sheets

SEQUENTIAL SLURRY HYDROCONVERSION OF HEAVY OILS

CROSS-REFERENCE TO RELATED APPLICATIONS

This application claims the benefit of priority from U.S. Provisional Application 61/837,377, filed on Jun. 20, 2013, titled "Sequential Slurry Hydroconversion of Heavy Oils", the entirety of which is incorporated herein by reference.

FIELD OF THE INVENTION

This invention provides methods for processing of resids and other heavy oil feeds or refinery streams.

BACKGROUND OF THE INVENTION

Slurry hydroprocesssing provides a method for conversion of high boiling, low value petroleum fractions into higher value liquid products. Slurry hydroconversion technology can process difficult feeds, such as feeds with high Conradson carbon residue (CCR), white still maintaining high liquid yields. In addition to resid feeds, slurry hydroconversion units have been used to process other challenging streams present in refinery/petrochemical complexes such as deasphalted rock, steam cracked tar, and visbreaker tar. Unfortunately, slurry hydroprocessing is also an expensive refinery process from both a capital investment standpoint and a hydrogen consumption standpoint.

Various slurry hydroprocessing configurations have previously been described. For example, U.S. Pat. No. 5,755,955 and U.S. Patent Application Publication 2010/0122939 provide examples of configurations for performing slurry hydroprocessing. U.S. Patent Application Publication 2011/0210045 also describes examples of configurations for slurry hydroconversion, including examples of configurations where the heavy oil feed is diluted with a stream having a lower boiling point range, such as a vacuum gas oil stream and/or catalytic cracking slurry oil stream, and examples of configurations where a bottoms portion of the product from slurry hydroconversion is recycled to the slurry hydroconversion reactor.

U.S. Patent Application Publication 2013/0075303 describes a reaction system for combining slurry hydroconversion with a coking process. An unconverted portion of the feed after slurry hydroconversion is passed into a coker for further processing. The resulting coke is described as being high in metals.

U.S. Patent Application Publication 2013/0112593 describes a reaction system for performing slurry hydroconversion on a deasphalted heavy oil feed. The asphalt from a deasphalting process and a portion of the unconverted material from the slurry hydroconversion can be gasified to form hydrogen and carbon oxides.

SUMMARY OF THE INVENTION

In an aspect, a method for processing a heavy oil feedstock is provided. The method includes providing a heavy oil feedstock having a 10% distillation point of at least about 650° F. (343° C.); exposing the heavy oil feedstock to a catalyst under first effective slurry hydroconversion conditions to form an effluent comprising at least a plurality of liquid products and a bottoms product, the first effective slurry hydroconversion conditions comprising a hydrogen partial pressure of about 1500 psig (10.3 MPag) or less; exposing at least a portion of the bottoms product to a second catalyst under second effective slurry hydroconversion conditions to form at least a second plurality of liquid products and a second bottoms product; and recycling at least a portion of the second bottoms product, the recycled portion of the second bottoms product being combined with the heavy oil feedstock prior to exposing the heavy oil feedstock under the first slurry hydroconversion conditions.

DETAILED DESCRIPTION OF THE EMBODIMENTS

Overview

Figure 1:
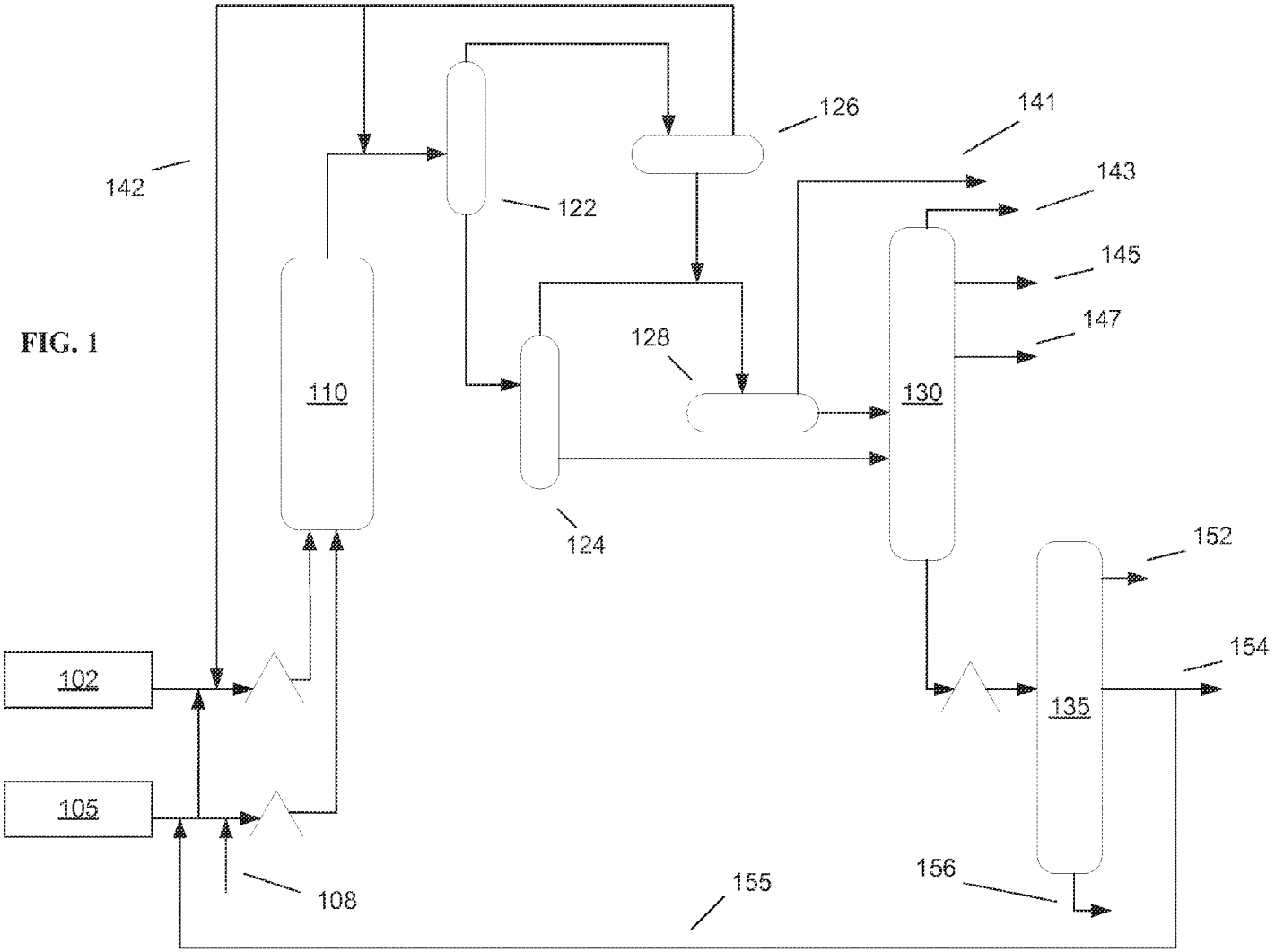
FIG. 1 shows an example of a slurry hydroconversion reaction system.

In various aspects, systems and methods are provided for hydroprocessing of a heavy oil feed, such as an atmospheric or vacuum resid. The systems and methods allow for improved conversion of a heavy oil feed to lower boiling range products while reducing, minimizing, and/or optimizing the required hydrogen consumption. A resid or other heavy oil feedstock is passed into one or more initial slurry hydroconversion reactors that are operated with a hydrogen partial pressure of about 1500 psig (10.3 MPag) or less, or about 1200 psig (8.2 MPag) or less, or about 1000 psig (6.9 MPag) or less, or about 800 psig (5.5 MPag) or less 500 psig (3.4 MPag) or less. The initial slurry hydroconversion reactors can convert at least about 25 wt % of the feedstock, or at least about 35 wt %, or at least about 50 wt %. Due to the low hydrogen partial pressure, the amount of hydrogen consumed in the initial stages is reduced relative to a high pressure slurry hydroconversion reactor. The conversion products from the initial slurry hydroconverson reactor(s) can be fractionated to generate separate fuels and gas oil fractions. The bottoms portion from the initial low pressure hydroconversion reactor(s) is then passed into a slurry hydroconversion reactor operating at a hydrogen partial pressure of at least about 2000 psig (13.8 MPag). The higher hydrogen partial pressure allows the second hydroconversion stage to further convert the bottoms so that net conversion of greater than 90 wt % is achieved relative to the initial feedstock.

Combination of low pressure and high pressure hydroconversion in sequence is a more effective approach for converting resid feeds, as a majority of 1050°+F. (566° C.) conversion is achieved by the initial low pressure hydroconversion stage. Low pressure slurry hydroconversion can convert about 80% of the 1050°+F. in atmospheric resid or whole bitumen feeds and 65-75% of 1050° F.+ in vacuum resids. The conversion is accomplished at low pressures, such as less than about 1500 psig (10.3 MPag), or less than about 1000 psig (6.9 MPag), or less than about 500 psig (3.4

MPag) employing dispersed $MoS_2$ catalyst in concentrations <500 ppm of Mo. This low pressure slurry hydroconversion process is effective in cleaving aliphatics from aromatics in resids resulting in formation of saturate rich distillates and a vacuum gas oil fraction which can be either hydrocracked or processed in a fluid catalytic cracking reactor. The remaining 20-35% of the 1050° F.+ (566° C.) fraction, which now represents a slurry hydroconversion bottoms portion, are rich in polyaromatic cores containing dispersed $MoS_2$ catalyst in the concentration range of 1500-2000 ppm Mo. The bottoms from the low pressure slurry hydroconversion reactor(s) can be then be sent to a high pressure slurry hydroconversion reactor to obtain complete or substantially complete conversion of 1050° F.+ fraction. In contrast to the low pressure slurry hydroconversion reactor, the high pressure reactor operates at a hydrogen partial pressure of at least about 2000 psig (13.8 MPag) of hydrogen. This high severity enables saturation of fused aromatic cores to vacuum gas oil and/or other low boiling fractions, such as fuels fractions.

Feedstocks

In various aspects, a hydroprocessed product is produced from a heavy oil feed component. Examples of heavy oils include, but are not limited to, heavy crude oils, distillation residues, heavy oils coming from catalytic treatment (such as heavy cycle bottom slurry oils from fluid catalytic cracking), thermal tars (such as oils from visbreaking, steam cracking, or similar thermal or non-catalytic processes), oils (such as bitumen) from oil sands and heavy oils derived from coal.

Heavy oil feedstocks can be liquid or semi-solid. Examples of heavy oils that can be hydroprocessed, treated or upgraded according to this invention include bitumens and residuum from refinery distillation processes, including atmospheric and vacuum distillation processes. Such heavy oils can have an initial boiling point of 650° F. (343° C.) or greater. Preferably, the heavy oils will have a 10% distillation point of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.). In this discussion, boiling points can be determined by a convenient method, such as ASTM D86, ASTM D2887, or another suitable standard method.

In addition to initial boiling points and/or 10% distillation points, other distillation points may also be useful in characterizing a feedstock, For example, a feedstock can be characterized based on the portion of the feedstock that boils above 1050° F. (566° C.). In some aspects, a feedstock can have a 70% distillation point of 1050° F. or greater, or a 60% distillation point of 1050° F. or greater, or a 50% distillation point of 1050° F. or greater, or a 40% distillation point of 1050° F. or greater.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 20° or less in one aspect, 15° or less in another aspect, and 10° or less in another aspect.

Heavy oil feedstocks (also referred to as heavy oils) can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The invention is particularly suited to treating heavy oil feedstocks containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

Slurry Hydroprocessing

FIG. 1 shows an example of a reaction system suitable for performing slurry hydroprocessing. The configuration in FIG. 1 is provided as an aid in understanding the general features of a slurry hydroprocessing process. It should be understood that, unless otherwise specified, the conditions described in association with FIG. 1 can generally be applied to any convenient slurry hydroprocessing configuration.

In FIG. 1, a heavy oil feedstock 105 is mixed with a catalyst 108 prior to entering one or more slurry hydroprocessing reactors 110. The mixture of feedstock 105 and catalyst 108 can be heated prior to entering reactor 110 in order to achieve a desired temperature for the slurry hydroprocessing reaction. A hydrogen stream 102 is also fed into reactor 110. In the configuration shown in FIG. 1, both the feedstock 105 and hydrogen stream 102 are shown as being heated prior to entering reactor 110. Optionally, a portion of feedstock 105 can be mixed with hydrogen stream 102 prior to hydrogen stream 102 entering reactor 110. Optionally, feedstock 105 can also include a portion of recycled vacuum gas oil 155. Optionally, hydrogen stream 102 can also include a portion of recycled hydrogen 142.

The effluent from slurry hydroprocessing reactor(s) 110 is passed into one or more separation stages. For example, an initial separation stage can be a high pressure, high temperature (HPHT) separator 122. A higher boiling portion from the HPHT separator 122 can be passed to a low pressure, high temperature (LPHT) separator 124 while a lower boiling (gas) portion from the HPHT separator 122 can be passed to a high temperature, low pressure (HTLP) separator 126. The higher boiling portion from the LPHT separator 124 can be passed into a fractionator 130. The lower boiling portion from LPHT separator 124 can be combined with the higher boiling portion from HPLT separator 126 and passed into a low pressure, low temperature (LPLT) separator 128. The lower boiling portion from HPLT separator 126 can be used as a recycled hydrogen stream 142, optionally after removal of gas phase contaminants from the stream such as $H_2S$ or $NH_3$. The lower boiling portion from LPLT separator 128 can be used as a flash gas or fuel gas 141. The higher boiling portion from LPLT separator 128 is also passed into fractionator 130.

In some configurations, HPHT separator 122 can operate at a temperature similar to the outlet temperature of the slurry hydroconversion reactor 110. This reduces the amount of energy required to operate the HPHT separator 122. However, this also means that both the lower boiling portion and the higher boiling portion from the HPHT separator 122 undergo the full range of distillation and further processing steps prior to any recycling of unconverted feed to reactor 110.

In an alternative configuration, the higher boiling portion from HPHT separator 122 is used as a recycle stream 118 that is added back into feed 105 for processing in reactor 110. In this type of alternative configuration, the effluent from reactor 110 can be heated to reduce the amount of converted material that is recycled via recycle stream 118. This allows the conditions in HPHT separator 122 to be separated from the reaction conditions in reactor 110.

In FIG. 1, fractionator 130 is shown as an atmospheric fractionator. The fractionator 130 can be used to form a plurality of product streams, such as a light ends or $C4^-$ stream 143, one or more naphtha streams 145, one or more diesel and/or distillate (including kerosene) fuel streams 147, and a bottoms fraction. The bottoms fraction can then be passed into vacuum fractionator 135 to form, for example, a light vacuum gas oil 152, a heavy vacuum gas oil 154, and a bottoms or pitch fraction 156. Optionally, other types and/or more types of vacuum gas oil fractions can be generated from vacuum fractionator 135 The heavy vacuum gas oil fraction 154 can be at least partially used to form a recycle stream 155 for combination with heavy oil feed 105.

In a reaction system, slurry hydroprocessing can be performed by processing a feed in one or more slurry hydroprocessing reactors. The reaction conditions in a slurry hydroprocessing reactor can vary based on the nature of the catalyst, the nature of the feed, the desired products, and/or the desired amount of conversion.

With regard to catalyst, suitable catalyst concentrations can range from about 50 wppm to about 20,000 wppm (or about 2 wt %), depending on the nature of the catalyst. Catalyst can be incorporated into a hydrocarbon feedstock directly, or the catalyst can be incorporated into a side or slip stream of feed and then combined with the main flow of feedstock. Still another option is to form catalyst in-situ by introducing a catalyst precursor into a feed (or a side/slip stream of feed) and forming catalyst by a subsequent reaction.

Catalytically active metals for use ire hydroprocessing can include those from Group IVB, Group VB, Group VIB, Group VIIB, or Group VIII of the Periodic Table. Examples of suitable metals include iron, nickel, molybdenum, vanadium, tungsten, cobalt, ruthenium, and mixtures thereof The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

A catalyst in the form of a solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials can include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

In some aspects, it can be desirable to form catalyst for slurry hydroprocessing in situ, such as forming catalyst from a metal sulfate (e.g., iron sulfate monohydrate) catalyst precursor or another type of catalyst precursor that decomposes or reacts in the hydroprocessing reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina).

The reaction conditions within a slurry hydroconversion reactor can include a temperature of about 400° C. to about 480° C., such as at least about 425° C., or about 450° C. or less. Some types of slurry hydroconversion reactors are operated under high hydrogen partial pressure conditions, such as having a hydrogen partial pressure of about 1200 psig (8.3 MPag) to about 3400 psig (214 MPag), for example at least about 1500 psig (10.3 MPag), or at least about 2000 psig (13.8 MPag). Examples of hydrogen partial pressures can be about 1200 psig (8.3 MPag) to about 3000 psig (20.7 MPag), or about 1200 psig (8.3 MPag) to about 2500 psig (1 7.2 MPag), or about 1500 psig (10.3 MPag) to about 3400 psig (23.4 MPag), or about 1500 psig (10.3 MPag) to about 3000 psig (20,7 MPag), or about 1500 psig (8.3 MPag) to about 2500 psig (17.2 MPag), or about 2000 psig (13.8 MPag) to about 3400 psig (23.4 Wag), or about 2000 psig (13.8 to MPag) to about 3000 psig (20.7 MPag), Since the catalyst is in slurry form within the feedstock, the space velocity for a slurry hydroconversion reactor can be characterized based on the volume of feed processed relative to the volume of the reactor used for processing the feed. Suitable space velocities for slurry hydroconversion can range, for example, from about 0.05 $v/v/hr^{-1}$ to about 5 $v/v/hr^{-1}$, such as about 0.1 $v/v/hr^{-1}$ to about 2 $v/v/hr^{-1}$.

The reaction conditions for slurry hydroprocessing can be selected so that the net conversion of feed across all slurry hydroprocessing reactors (if there is more than one arranged in series) is at least about 80%, such as at least about 90%, or at least about 95%, For slurry hydroprocessing, conversion is defined as conversion of compounds with boiling points greater than a conversion temperature, such as 975° F. (524° C.), to compounds with boiling points below the conversion temperature. Alternatively, the conversion temperature for defining the amount of conversion can be 1050° F. (566° C.). The portion of a heavy feed that is unconverted after slurry hydroprocessing can be referred to as pitch or a bottoms fraction from the slurry hydroprocessing.

In some alternative aspects, multiple slurry hydroconversion stages and/or reactors can be used for conversion of a feed. In such aspects, the effluent from a first slurry hydroconversion stage can he fractionated to separate out one or more product fractions. For example, the feed can be fractionated to separate out one or more naphtha fractions and/or distillate fuel (such as diesel) fractions. Such a fractionation can also separate out lower boiling compounds, such as compounds containing 4 carbons or less and contaminant gases such as $H_2S$ or $NH_3$. The remaining higher boiling fraction of the feed can have a boiling range roughly corresponding to an atmospheric resid, such as a 10 wt % boiling point of at least about 650° F. (343° C.) or at least about 700° F. (371° C.). At least a portion of this higher boiling fraction can be passed into a second (or later) slurry hydroconversion stage for additional conversion of the 975° F.+ (524° C.) portion, or optionally the 1050° F.+ (566° C.) portion of the feed. By separating out the lower portions after performing an intermediate level of conversion, the amount of "overcracking" of desirable products can be reduced or minimized.

In aspects where multiple slurry hydroconversion stages are used to achieve an overall conversion level, the conditions for an initial slurry hydroconversion stage can be selected to achieve about 25 wt % to about 60 wt % conversion on the 975° F.+ (524° C.) portion, or optionally the 1050° F.+ (566° C.) portion of the feed, such as at least about 35 wt % or at least about 45 wt %, or about 50 wt % or less, or about 40 wt % or less. The conditions in a second (or other subsequent) slurry hydroconversion stage can then be selected to achieve a total desired level of conversion for the 975° F.+ (524° C.) portion or 1050° F.+ (566° C.) portion of the feed as described above.

In some aspects, using multiple stages of slurry hydroconversion reactors can allow for selection of different processing conditions in the stages and/or reactors. For example, the temperature in the first slurry hydroconversion reactor can be lower than the temperature in a second reactor. In such an aspect, the second effective hydroprocessing conditions for use in the second slurry hydroconversion reactor can include a temperature that is at least about 5° C. greater than a temperature for the first effective slurry hydroprocessing conditions in the first reactor, or at least about 10° C. greater, or at least about 15° C. greater, or at least about 20° C. greater, or at least about 30° C. greater, or at least about 40° C. greater, or at least about 50° C. greater. From a practical standpoint, typical slurry hydroprocessing temperatures are from about 400° C. to about 480° C., so the difference between any two reaction stages can typically be about 80° C. or less.

Additionally or alternately to having a different temperature between slurry hydroconversion stages, the hydrogen partial pressure and/or total pressure used in a first slurry hydroconversion stage can differ from a second slurry hydroconversion stage. One option is to have a lower hydrogen partial pressure and/or lower total pressure for a first slurry hydroconversion stage. This can reflect the desire to have lower severity conditions in the first slurry hydroconversion stage relative to a subsequent stage. For example, the hydrogen partial pressure in a first slurry hydroconversion stage can be tower than a hydrogen partial pressure in a subsequent (such as a second or later) slurry hydroconversion stage by at least about 50 psi (350 kPa), or at least about 100 psi (690 kPa), or at least about 200 psi (1380 kPa). In aspects where roughly comparable amounts of hydrogen are delivered in the treat gases to various stages, one option for controlling the hydrogen partial pressure can be to select a lower total pressure for a first to stage relative to a subsequent stage. For example, the total pressure in a first slurry hydroconversion stage can be lower than a total pressure in a subsequent (such as a second or later) slurry hydroconversion stage by at least about 50 psi (350 kPa), or at least about 100 psi (690 kPa), or at least about 200 psi (1380 kPa), or at least about 300 psi (2070 kPa). Still another alternative can be to have a lower hydrogen partial pressure in a second or o her subsequent slurry hydroconversion stage relative to a first slurry hydroconversion stage. For example, the hydrogen partial pressure in a second (or other subsequent) slurry hydroconversion stage can be lower than a hydrogen partial pressure in a first slurry hydroconversion stage by at least about 50 psi (350 kPa), or at least about 100 psi (690 kPa), or at least about 200 psi (1380 kPa).

When multiple reactors are used, the catalyst for the slurry hydroconversion can be passed between reactors with a single recycle loop. In this type of configuration, catalyst is separated from the heavy product fraction of the final hydroconversion stage and then at least partially recycled to an earlier hydroconversion stage. Alternatively, a separate catalyst recycle loop can be used for at least one slurry hydroconversion stage. For example, if a plurality of reactors are used, the slurry catalyst can be separated from the heavy portion of the effluent from each reactor. The separated catalyst from the first reactor can then be recycled back to the first reactor, the separated catalyst from the second reactor can be recycled back to the second reactor, and separated catalyst from each additional reactor (if any) can be recycled to the corresponding reactor. Still another option is to have multiple catalyst separations and recycle loops, but to have fewer recycle loops than the total number of reactors. For example, a first reactor can have a separate catalyst recycle loop, while catalyst can be passed between a second and third reactor, with catalyst separated from the product effluent of the third reactor and recycled (at least in part) back to the second reactor.

When more than one catalyst recycle loop is used, the catalyst recycle loop for a stage can be effective for reducing the weight percentage of catalyst in an output fraction, For example, the weight percentage of catalyst in an output fraction after catalyst separation can be about 25% or less of the weight percentage in the fraction prior to separation, or about 15% or less, or about 10% or less.

Figure 3:
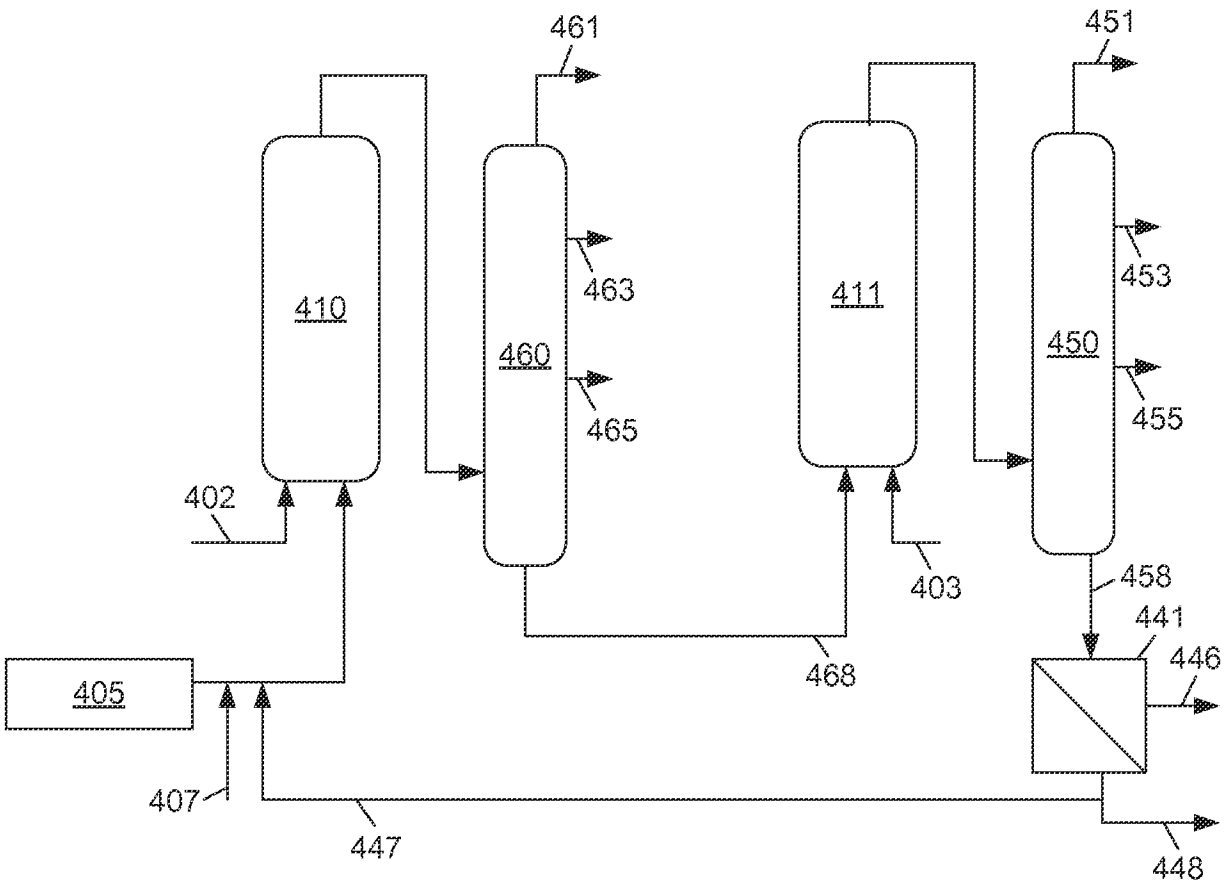
FIG. 3 shows an example of a configuration involving multiple slurry hydroconversion reactors with interstage separation.

FIG. 3 shows an example of an alternative configuration for performing slurry hydroprocessing using multiple stages and/or reactors. In a configuration such as FIG. 3, multiple stages of slurry hydroprocessing can be performed under different processing conditions. A separation or fractionation can be performed between stages to allow for removal of product fractions. This can increase the recovery of higher value products by reducing or minimizing overprocessing of the feedstock to the slurry hydroprocessing stages.

In FIG. 3, a heavy oil feed 405 (or a fed including at least a heavy oil portion) is passed into a slurry hydroconversion reactor 410. In the configuration shown in FIG. 3, an input stream of hydrogen 402 is also introduced into reactor 410. The input stream of hydrogen 402 can correspond to a fresh hydrogen stream, a recycled hydrogen stream from a downstream stage of the reaction system, or another convenient hydrogen stream. Optionally, hydrogen stream 402 can be mixed with feed 405 prior to entering reactor 410. In the configuration shown in FIG. 3, a stream of recycled catalyst 447 is shown as being mixed with feed 405. The catalyst from recycled catalyst stream 447 can be supplemented with additional fresh catalyst 407.

The feed 405 (including catalyst from recycled catalyst stream 447 and/or fresh catalyst 407) is passed into slurry hydroprocessing reactor 410. The reactor 410 can be operated under effective slurry hydroprocessing conditions for converting a portion of the resid in the feed. Because the configuration in FIG. 3 includes multiple slurry hydroconversion reactors, the effective conditions can be selected to produce an intermediate amount of conversion, such as about 20 wt % to about 60 wt % of the 975° F.+ portion of the feed. The effluent from reactor 410 can be separated or fractionated, such as in a fractionator 460. This can form a variety of fractions, such as a light ends fraction 461, a naphtha fraction 463, a diesel fraction 465, and a higher boiling fraction 468, It is noted that the catalyst in the slurry can be primarily entrained in the higher boiling fraction 468.

The higher boiling fraction 468 can be passed into a second slurry hydroconversion reactor 411 along with additional hydrogen 403. The higher boiing fraction can be processed under second effective slurry hydroprocessing conditions in reactor 411 to achieve a desired total amount of conversion of the 975° F.+ (524° C.) portion or the 1050° F.+ (566° C.) portion of the original feed. The effluent from reactor 411 can then be fractionated 450 to form, for example, a light ends fraction 451, a naphtha fraction 453, a distillate fuel fraction 455, and a higher boding fraction 458. This higher boiling fraction 458 can correspond to a bottoms or resid fraction. The slurry catalyst can typically be entrained in the higher boiling fraction 458, The higher boiling fraction 458 can then be separated, such as by using a settler 441, a filter, or another, type of separator, to separate a vacuum gas oil fraction 446 from the slurry catalyst. Optionally, at least a portion of vacuum gas oil fraction 446 can correspond to compounds having a boiling point above the conversion temperature, such as a conversion temperature of about 975° F. (524° C.) or 1050° F. (566° C.). A portion of the slurry catalyst can be purged 448 from the reaction system, while a remaining portion of the slurry catalyst can be recycled 407 for use again in the slurry hydroconversion reactors. Purging a portion of the slurry catalyst can reduce or minimize the build up of heavy metals that may deposit on the catalyst during the slurry hydroconversion process.

Figure 4:
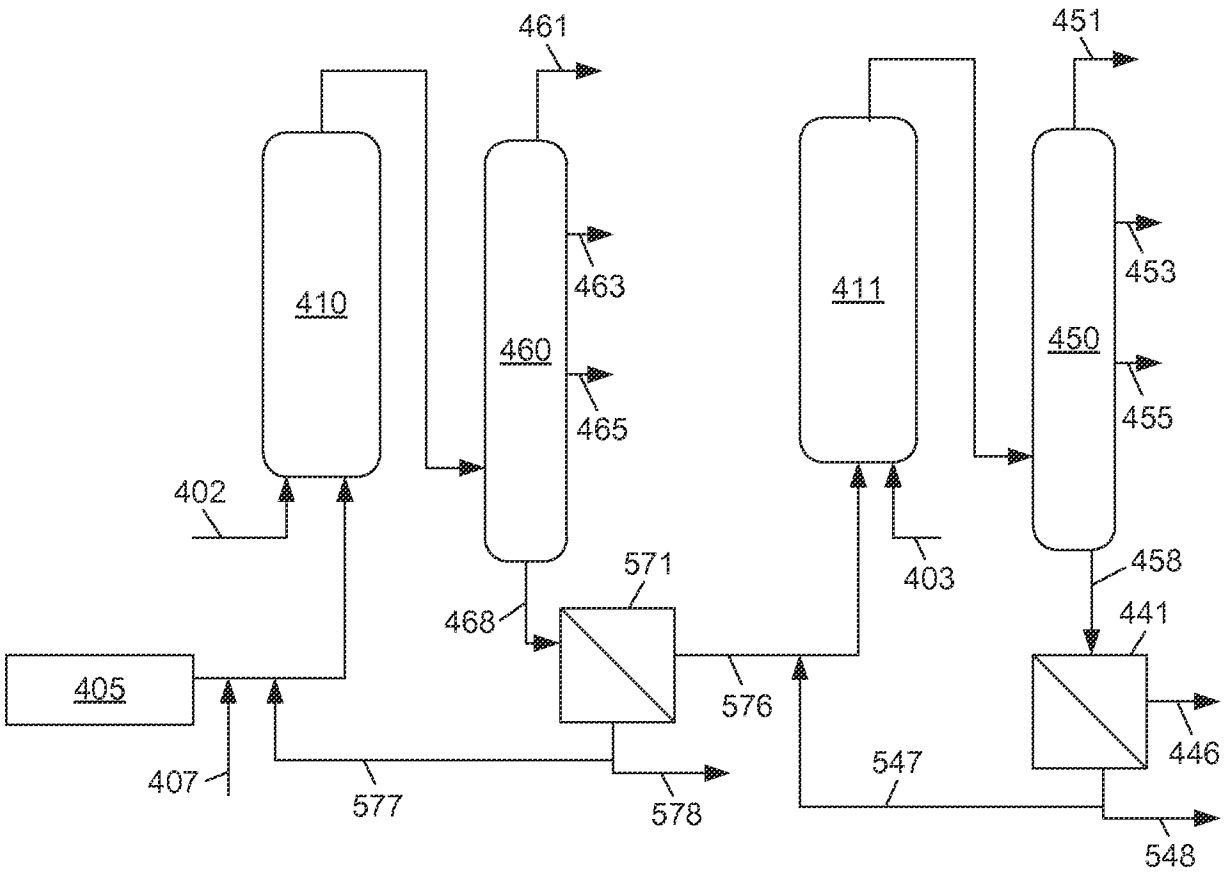
FIG. 4 shows an example of a configuration involving multiple slurry hydroconversion reactors with interstage separation.

In the configuration shown in FIG. 3, the slurry hydroprocessing catalyst is passed from the first reactor 410 to the second reactor 411 during processing, The catalyst is then separated out using settler 441 or another type of separator or filter. However, another option for handling the catalyst within multiple slurry hydroconversion reactors can be to have a separate catalyst recycle loop for each reactor and/or stage. This type of configuration is shown in FIG. 4. In FIG. 4, many of the elements shown are similar to FIG. 3. In FIG. 4, the higher boiling portion 468 of the effluent from the first slurry hydroconversion reactor 410 can typically contain a majority of the slurry catalyst, such as at least about 50 wt % of the catalyst present in the effluent from the reactor 410 prior to fractionation. However, most of the catalyst from the first slurry hydroconversion reactor 410 is not passed into the second reactor. Instead, a settler 471 or another type of separator or filter is used to separate the catalyst from the higher boiling feed portion 468. This results in a separated higher boiling portion 576 that includes a weight percentage of catalyst that is about 25% or less of the weight percentage of catalyst in the higher boiling feed portion 468, or about 15% or less, or about 10% or less. After the separation, the separated higher boiling portion 576 is used as the input feed for the second slurry hydroconversion reactor 411. A portion of to the separated catalyst is purged from the system 578, while a remaining portion of the separated catalyst is recycled 576. A similar separation can be performed on the higher boiling portion 458, to produce a catalyst recycle stream 547 and a catalyst purge stream 548.

Figure 5:
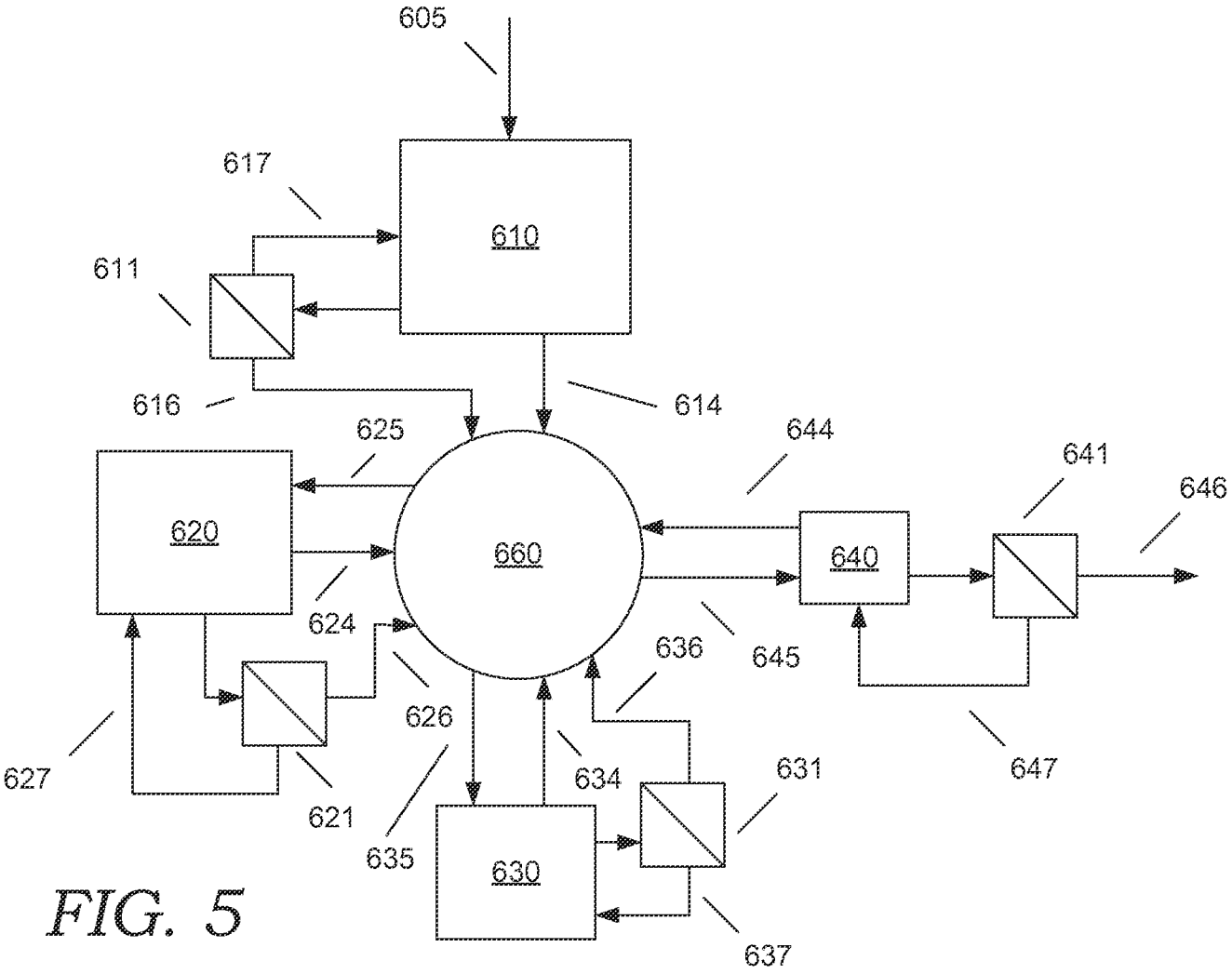
FIGS. 5 and 6 show an example of a configuration for using a divided wall fractionator in conjunction with multiple slurry hydroconversion reactors.

FIG. 5 shows still another configuration for using multiple slurry hydroconversion reactors for treatment of a feed. In FIG. 5, a configuration is schematically shown for using a single fractionator containing internal dividing walls for performing fractionation on effluents from multiple slurry hydroconversion reactors. In the example shown in FIG. 5, a fractionator 660 with internal dividing walls is shown as being associated with four separate slurry hydroconversion reactors 610, 620, 630, and 640. Of course, other numbers or groupings for a plurality of hydroconversion reactors can be used with a divided wall fractionator.

In the example shown in FIG. 5, a feed 605 for slurry hydroconversion (such as a resid feed) is passed into slurry hydroconversion reactor 610. In FIG. 5, a flash separator (not shown) or another simple separation device can be used to separate the effluent from the slurry hydroconversion reactor 610 into a lighter fraction 614 and a bottoms (or other higher boiling) fraction that includes the majority of the slurry catalyst. The bottoms fraction is passed through a settler 611 (or another type of separator) to produce a catalyst recycle stream 617 and a bottoms fraction 616 with a reduced content of slurry catalyst. Both lighter fraction 614 and bottoms fraction 616 with reduced content of slurry catalyst can then be passed into the divided wall fractionator 660.

Figure 6:
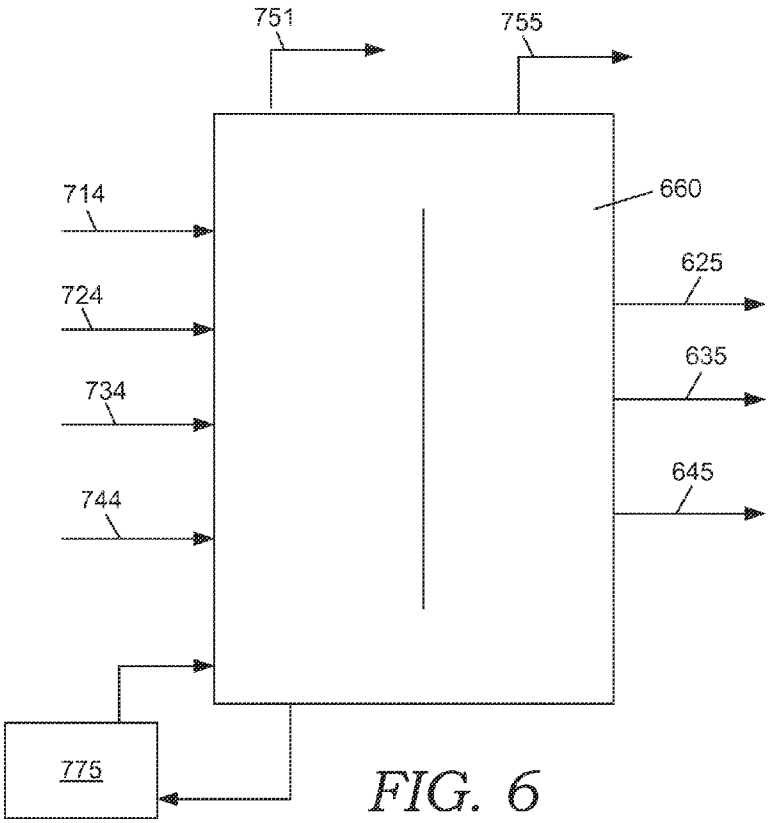

The divided wall fractionator can then be used to distribute portions of the lighter fraction 614 and bottoms fraction 616 to additional slurry hydroconversion reactors 620, 630, and 640. In FIG. 6, the lighter fraction and the bottoms fraction with reduced catalyst content from the first reactor are represented by a single input stream 714. The similar lighter fractions and bottoms fractions from the other reactors in FIG. 5 are represented by input streams 724, 734, and 744. The various fractions are introduced into the divided wall fractionator 660 on a first side of the divider. Lighter fractions are removed from the fractionator 660 above the dividing wall. This can include, for example, light ends 751 and one or more naphtha or distillate fuel fractions 755.

As shown in FIG. 6, output streams 625, 635, and 645 are withdrawn from fractionator 660 at various heights (on the opposite side of the dividing wall) corresponding to different boiling ranges within the resid boiling range. The output stream 625 is used to feed reactor 620 as shown in FIG. 5, and similarly output stream 635 feeds reactor 630 while output stream 645 feeds reactor 640. This allows reactors 620, 630, and 640 to process fractions with different boiling ranges, to allow for further adjustment of conditions in each of reactors 620, 630, and 640 to improve overall Similar to the situation for reactor 610, the stream 625/635/645 is passed into slurry hydroconversion reactor 620/630/640. In FIG. 5, a flash separator (not shown) or another simple separation device can be used to separate the effluent from the slurry hydroconversion reactor 620/630/640 into a lighter fraction 624/634/644 and a bottoms (or other higher boiling) fraction 626/636/646 that includes the majority of the slurry catalyst. The bottoms fraction 626/636/646 is passed through a settler 621/631/641 to produce a catalyst recycle stream 627/637/647 and a bottoms fraction 626/636/646 with a reduced content of slurry catalyst. For reactors 620 and 630, both lighter fraction 624/634 and bottoms fraction 626/636 with reduced content of slurry catalyst are passed into the divided wall fractionator 660. For reactor 640, the lighter fraction 644 is also passed into the divided wall fractionator 660. The bottoms fraction 646 represents a vacuum gas oil product that can be used as low sulfur fuel oil and/or can be further hydroprocessed to form additional fuel products.

Low Pressure Slurry Hydroconversion

In various aspects, an initial slurry hydroconversion stage (or stages) can be operated with a reduced hydrogen partial pressure, such as a hydrogen partial pressure of about 1500 psig (10.3 MPag) or less, or 1200 psig (8.3 MPag) or less, or 1000 psig (6.9 MPag) or less, or 800 psig (5.5 MPag) or less, or 500 psig (3.4 MPag) or less. Under reduced hydrogen partial pressure conditions, the slurry hydroconversion process is suitable for conversion of 25 wt % to 70 wt % of a heavy oil feedstock to compounds with a boiling point of about 1050° C. (566° C.) or less, or 40 wt % to 70 wt %, or 25 wt % to 50 wt %, or 35 wt % to 60 wt %. This level of conversion can be achieved while consuming a. reduced amount of hydrogen, resulting in substantial savings of hydrogen as a resource. The effluent from the low pressure slurry hydroconversion reactor(s) can be fractionated. to form various product fractions, such as fuels and/or gas oil boiling range fractions.

A catalyst can be introduced into the low pressure slurry hydroconversion reactor similar to the types of catalysts used in a higher, pressure reactor, Catalyst in the low pressure reactor will tend to accumulate in the bottoms product generated during slurry hydroconversion. This can lead to an increased catalyst concentration in the higher pressure slurry hydroconversion reactor. Optionally, additional catalyst can also be introduced into the higher pressure hydroconversion reactor.

Optionally, a portion of the catalyst introduced into the low pressure slurry hydroconversion reactor can correspond to fine catalyst particles generated during coking of a heavy oil feed. Such coker fines can accumulate in the bottoms or vacuum gas oil and/or vacuum resid boiling range fraction generated by a coker. The coker fines can be high in Ni and V content, making a stream with coker fines somewhat difficult to deal with in a conventional refinery process. However, such a feed can be suitable for inclusion in a feed for processing in a low pressure slurry hydroprocessing reactor. The coker fines can become incorporated into the slurry pitch, which can then be processed according to typical procedures for handling the slurry pitch.

Still another variation on low pressure slurry hydroconversion can be to integrate the slurry hydroconversion reactor with a coker while using a refinery fuel gas as the hydrogen source for the slurry hydroconversion reactor. Refinery fuel gas can include a relatively low proportion of hydrogen, such as from about 25 vol % to about 60 vol % hydrogen. The remaining portion of the fuel gas can correspond to other types of hydrocarbons containing 4 or fewer carbons, as well as less than 1 vol % of CO. Optionally but preferably, the refinery fuel gas can correspond to a refinery fuel gas that has been desulfurized, so that the refinery fuel gas is substantially free of $H_2S$. In a low pressure reaction environment, the refinery fuel gas can facilitate performing at least some conversion of a feed under low pressure slurry hydroprocessing conditions. The pitch generate by the slurry hydroconversion reactor under these low pressure, low $H_2$ partial pressure conditions can then be passed into a coker for further processing. This pitch may represent a larger percentage of the feed than usual, due to the mild slurry hydroprocessing conditions.

The reaction conditions in a low pressure slurry hydroconversion reactor can be similar to a high pressure reactor, with the exception of a lower pressure and optionally a tower catalyst concentration. The hydrogen partial pressure can be about 1500 psig (10.3 MPag) or less, such as about 1000 psig (6.9 MPag) or less or 500 psig MPag) or less. The catalyst concentration in the low pressure reactor can be related to the high pressure reactor based on the amount of conversion. Because the catalyst will concentrate in the bottoms portion that is passed into the high pressure slurry hydroconversion reactor, the amount of catalyst concentration will depend on the amount of conversion in the low pressure reactor.

The conditions for the low pressure slurry hydroconversion can be effective for conversion of at least about 25 wt % of a feedstock, such as at least about 35 wt %, or at least about 40 wt %, or at least about 50 wt %, and/or about 70 wt % or less, or about 60 wt % or less, or about 50 wt % or less. After conversion of the bottoms portion by a high pressure slurry hydroconversion process, the overall conversion can be at least about 80 wt %, such as at least about 90 wt %, or at least about 95 wt %, or at least about 97 wt %.

Figure 2:
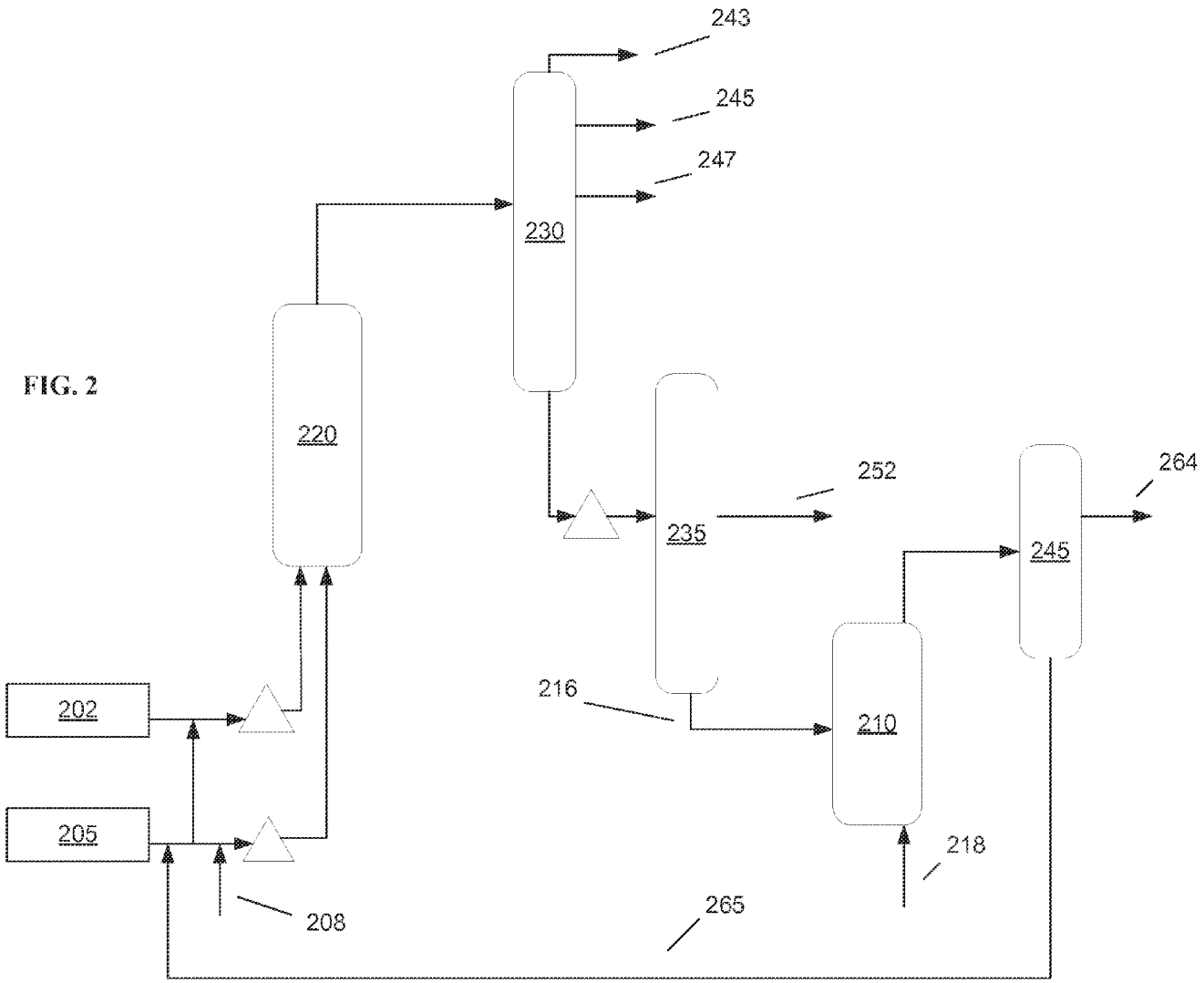
FIG. 2 shows an example of a reaction system including a low pressure slurry hydroconversion reactor and a high pressure slurry hydroconversion reactor.

FIG. 2 shows an example of a reaction system including both a low pressure slurry hydroconversion reactor and a high pressure slurry hydroconversion reactor. In FIG. 2, a resid (or other heavy oil) feedstock 205 is introduced into a low pressure slurry hydroconversion reactor 220. Make-up catalyst 202 is also introduced into reactor 220. Hydrogen 208 for the slurry hydroconversion reaction can be introduced in any convenient manner, such as mixing the hydrogen into feedstock 205 prior to entering reactor 220, The effluent from slurry hydroconversion reactor 220 is then fractionated to separate one or more converted product fractions from an unconverted bottoms portion. For example, an atmospheric fractionator 230 can be used to form a light ends portion 243, a naphtha portion 245, and a diesel portion 247. The bottoms portion can then be vacuum fractionated 235 to form a gas oil or lubricant base oil boiling range portion 252 and a vacuum bottoms portion. The vacuum bottoms 216 can then be passed into a high to pressure slurry hydroprocessing reactor 210, along with additional hydrogen 218, The effluent from reactor 210 is then fractionated 245 to form one or more products fractions 264 and a bottoms fraction 265. A bleed stream (not shown) can be used to remove pitch from the reaction system. The remaining portion of bottoms 265 can be recycled for use as part of the feed to either low pressure reactor 220 or high pressure reactor 210.

Additional Embodiment

Embodiment 1. A method for processing a heavy oil feedstock, comprising: providing a heavy oil feedstock having a 10% distillation point of at least about 650° F. (343° C.); exposing the heavy oil feedstock to a catalyst under first effective slurry hydroconversion conditions to form an effluent comprising at least a plurality of liquid products and a bottoms product, the first effective slurry hydroconversion conditions comprising a hydrogen partial pressure of about 1500 psig (10.3 MPag) or less, optionally about 1000 psig (6.9 MPag) or less, optionally about 500 psig (3.4 MPag) or less; exposing at least a portion of the bottoms product to the catalyst under second effective slurry hydroconversion conditions to form at least a second plurality of liquid products and a second bottoms product; and recycling at least a portion of the second bottoms product, the recycled portion of the second bottoms product being combined with the heavy oil feedstock prior to exposing the heavy oil feedstock under the first slurry hydroconversion conditions.

Embodiment 2. A method for processing a heavy oil feedstock, comprising: providing a heavy oil feedstock having a 10% distillation point of at least about 650° F. (343° C.); exposing the heavy oil feedstock to a catalyst under first effective slurry hydroconversion conditions to form an effluent comprising at least a plurality of liquid products and a bottoms product, the first effective slurry hydroconversion conditions comprising a hydrogen partial pressure of about 1500 psig (10.3 MPag) or less; exposing at least a portion of the bottoms product to a second catalyst under second effective slurry hydroconversion conditions to form at least a second plurality of liquid products and a second bottoms product; and recycling at least a portion of the second bottoms product, the recycled portion of the second bottoms product being combined with the heavy oil feedstock prior to exposing the heavy oil feedstock under the first slurry to hydroconversion conditions.

Embodiment 3. The method of Embodiment 2, wherein the bottoms fraction comprises a portion of the first catalyst corresponding to at least about 50% of the first catalyst in the first slurry hydroconversion effluent, wherein exposing the bottoms fraction to the second catalyst comprises exposing at least a portion the bottoms fraction is to the second catalyst.

Embodiment 4. The method of any of Embodiments 2 or 3, wherein the second catalyst is the portion of the first catalyst contained in the bottoms fraction.

Embodiment 5. The method of any of Embodiments 2 or 3, further comprising separating the bottoms fraction to form a first catalyst fraction and a catalyst depleted resid or bottoms fraction, the catalyst-depleted bottoms fraction containing about 25 wt % or less of the catalyst in the bottoms fraction prior to separation, wherein exposing at least a portion of the slurry resid or bottoms fraction to the second catalyst comprises exposing at least a portion of the catalyst-depleted bottoms fraction to the second catalyst.

Embodiment 6. The method of Embodiment 5, further comprising introducing the second catalyst into the catalyst-depleted bottoms fraction.

Embodiment 7. The method of any of the above embodiments, wherein the 10% distillation point of the heavy oil feedstock is at least about 900° F. (482° C.).

Embodiment 8. The method of any of the above embodiments, wherein the heavy oil feedstock has a Conradson carbon residue of greater than about 5 wt %.

Embodiment 9. The method of any of the above embodiments, wherein the heavy oil feedstock has a Conradson carbon residue of less than about 30 wt %.

Embodiment 10. The method of any of the above embodiments, further comprising: combining at least a portion of one or more of the first plurality of liquid products with at least a portion of one or more of the plurality of second liquid products; hydroprocessing the combined liquid products; and fractionating the combined liquid products.

Embodiment 11. The method of claim 10, wherein hydroprocessing the combined liquid products comprises hydrotreating the combined liquid products.

Embodiment 12. The method of any of the above embodiments, wherein the first effective slurry hydroconversion conditions are effective for conversion of about 25 wt % to about 60 wt % of the heavy oil feedstock relative to a conversion temperature of at least about 975° F. (524° C.).

Embodiment 13. The method of any of the above embodiments, wherein the first effective slurry hydroconversion conditions and the second slurry hydroconversion conditions are effective for a combined conversion of at least about 90 wt % of the heavy oil feedstock relative to a conversion temperature of at least about 975° F. (524° C.).

Embodiment 14. The method of any of the above embodiments, wherein the second effective slurry hydroconversion conditions comprise a catalyst concentration that is at least twice a catalyst concentration of the first effective slurry hydroconversion conditions.

Embodiment 15. The method of any of the above embodiments, wherein the hydrogen partial pressure of the first effective slurry hydroconversion conditions is about 1000 psig (6.9 MPag) or less, optionally about 500 psig (3.4 MPag) or less.

Embodiment 16. The method of any of the above embodiments, wherein the hydrogen partial pressure of the second effective slurry hydroconversion conditions is at least about 2000 psig (13.8 MPag).

Embodiment 17. The method of any of the above embodiments, wherein a temperature of the second effective slurry hydroconversion conditions is greater than a temperature of the first effective slurry hydroconversion conditions by about 110° C. to about 80° C.

Embodiment 18. The method of claim 17, wherein a temperature of the second effective slurry hydroconversion conditions is greater than a temperature of the first effective slurry hydroconversion conditions by at least about 20° C.

Embodiment 19. The method of any of the above embodiments, further comprising fractionating the first slurry hydroconversion effluent to form at least one of a naphtha fraction or a distillate fuel fraction, and the bottoms fraction.

Embodiment 20. The method of claim 19, wherein the first slurry hydroconversion effluent is fractionated in a divided wall fractionator, the method further comprising fractionating the second slurry hydroconversion effluent in the divided wall fractionator.

What is claimed is:

1. A method for processing a heavy oil feedstock, comprising:

providing a heavy oil feedstock having a 10% distillation point of at least about 650° F. (343° C.);

exposing the heavy oil feedstock to a catalyst under first effective slurry hydroconversion conditions to form an effluent comprising at least a first plurality of liquid products and a bottoms product, the first effective slurry hydroconversion conditions comprising a hydrogen partial pressure of about 1500 psig (10.3 MPag) or less;

exposing at least a portion of the bottoms product to the catalyst under second effective slurry hydroconversion conditions comprising hydrogen partial pressure of at least about 2000 psig (13.8 MPag) to form at least a second plurality of liquid products and a second bottoms product; and recycling at least a portion of the second bottoms product, the recycled portion of the second bottoms product being combined with the heavy oil feedstock prior to exposing the heavy oil feedstock under the first slurry hydroconversion conditions.

2. A method for processing a heavy oil feedstock, comprising:

providing a heavy oil feedstock having a 10% distillation point of at least about 650° F. (343° C.);

exposing the heavy oil feedstock to a catalyst under first effective slurry hydroconversion conditions to form an effluent comprising at least a first plurality of liquid products and a bottoms product, the first effective slurry hydroconversion conditions comprising a hydrogen partial pressure of about 1500 psig (10.3 MPag) or less;

exposing at least a portion of the bottoms product to a second catalyst under second effective slurry hydroconversion conditions comprising hydrogen partial pressure of at least about 2000 psig (13.8 MPag) to form at least a second plurality of liquid products and a second bottoms product; and recycling at least a portion of the second bottoms product, the recycled portion of the second bottoms product being combined with the heavy oil feedstock prior to exposing the heavy oil feedstock under the first slurry hydroconversion conditions.

3. The method of claim 2, wherein the bottoms product comprises a portion of the first catalyst corresponding to at least about 50% of the first catalyst in the effluent, wherein exposing the bottoms product to the second catalyst comprises exposing at least a portion the bottoms product to the second catalyst.

4. The method of claim 2, wherein the second catalyst is the portion of the first catalyst contained in the bottoms product.

5. The method of claim 2, further comprising separating the bottoms product to form a first catalyst fraction and a catalyst-depleted resid or bottoms fraction, the catalyst-depleted bottoms fraction containing about 25 wt % or less of the catalyst in the bottoms fraction prior to separation, wherein exposing at least a portion of the slurry resid or bottoms fraction to the second catalyst comprises exposing at least a portion of the catalyst-depleted bottoms fraction to the second catalyst.

6. The method of claim 5, further comprising introducing the second catalyst into the catalyst-depleted bottoms fraction.

7. The method of claim 1, wherein the 10% distillation point of the heavy oil feedstock is at least about 900° F.

8. The method of claim 1, wherein the heavy oil feedstock has a Conradson carbon residue of greater than about 5 wt %.

9. The method of claim 1, wherein the heavy oil feedstock has a Conradson carbon residue of less than about 30 wt %.

10. The method of claim 1, further comprising:

combining at least a portion of one or more of the first plurality of liquid products with at least a portion of one or more of the second plurality of liquid products;

hydroprocessing the combined liquid products; and fractionating the combined liquid products.

11. The method of claim 10, wherein hydroprocessing the combined liquid products comprises hydrotreating the combined liquid products.

12. The method of claim 1, wherein the first effective slurry hydroconversion conditions are effective for conversion of about 25 wt % to about 60 wt % of the heavy oil feedstock relative to a conversion temperature of at least about 975° F. (524° C.).

13. The method of claim 1, wherein the first effective slurry hydroconversion conditions and the second slurry hydroconversion conditions are effective for a combined conversion of at least about 90 wt % of the heavy oil feedstock relative to a conversion temperature of at least about 975° F. (524° C.).

14. The method of claim 1, wherein the second effective slurry hydroconversion conditions comprise a catalyst concentration that is at least twice a catalyst concentration of the first effective slurry hydroconversion conditions.

15. The method of claim 1, wherein the hydrogen partial pressure of the first effective slurry hydroconversion conditions is about 500 psig (3.4 MPag) or less.

16. The method of claim 1, wherein a temperature of the second effective slurry hydroconversion conditions is greater than a temperature of the first effective slurry hydroconversion conditions by about 10° C. to about 80° C.

17. The method of claim 16, wherein a temperature of the second effective slurry hydroconversion conditions is greater than a temperature of the first effective slurry hydroconversion conditions by at least about 20° C.

18. The method of claim 1, further comprising fractionating the first slurry hydroconversion effluent to form at least one of a naphtha fraction or a distillate fuel fraction, and the bottoms fraction.

19. The method of claim 18, wherein the first slurry hydroconversion effluent is fractionated in a divided wall fractionator, the method further comprising fractionating the second slurry hydroconversion effluent in the divided wall fractionator.

* * * * *